US006420840B1

(12) United States Patent
Albright

(10) Patent No.: US 6,420,840 B1
(45) Date of Patent: Jul. 16, 2002

(54) PLASMA COLUMN

(76) Inventor: Larry Albright, 419 Sunset Ave., Venice, CA (US) 90291

( * ) Notice: Subject to any disclaimer, the term of this patent is extended or adjusted under 35 U.S.C. 154(b) by 0 days.

(21) Appl. No.: 09/500,600

(22) Filed: Feb. 8, 2000

(51) Int. Cl.[7] ..... H01J 61/30
(52) U.S. Cl. ..... 315/330; 313/634
(58) Field of Search ..... 315/326, 246, 315/330; 313/25, 567, 634

(56) References Cited

U.S. PATENT DOCUMENTS 1,851,532 A * 3/1932 Vollrath
5,281,898 A * 1/1994 Albright ..... 315/326
6,057,635 A * 5/2000 Nishimura et al. ..... 313/25

* cited by examiner

*Primary Examiner*—David Vu
(74) *Attorney, Agent, or Firm*—Howard C. Miskin; Gloria Tsui-Yip

(57) ABSTRACT

A plasma discharge display device comprises a generally columnar chamber with a pair of electrodes tangentially located at opposite ends of the chamber for ionizing gas in the chamber. The columnar chamber comprises a cylindrical portion interconnected with a generally spherical portion. The configuration of the chamber generates an active (but not hyperactive) plasma discharge that is continuous, has a full motion and with minimal noise without the need of additional adulterants for instability.

8 Claims, 2 Drawing Sheets

PLASMA COLUMN

FIELD OF THE INVENTION

The invention relates to a device for displaying plasma discharge; in particular, the device has a columnar structure for the ornamental display of a full-motion and continuous plasma discharge.

BACKGROUND OF THE INVENTION

Plasma discharges replicate the appearance of bolts of lightning in a safe and confined environment. Such plasma discharge displays are common as three-dimensional art or novelty items; in particular, in the form of a double glass spherical unit. U.S. Pat. No. 5,281,898 to the inventor herein shows an example of a spherical unit 28.

Plasma discharges result from the ionization of gas contained in an enclosed area excited by high voltage. Normally, ionized gas in an enclosed area produces a smooth laminar discharge. To achieve the intended animated lightning effect, instability must be introduced to encourage the gas to break away from the natural laminar flow. Adulterants in traces of 5–20 parts per million are added to the gas of prior art display units to create active and unstable ionized gas (or plasma discharge). Adulterants such as nitrogen and oxygen may be used. Prior art display units require a delicate balance of gas mixture to achieve instability. Another inherent drawback of adding adulterants to non-inert gases is that it disadvantageously reduces the lifetime of the active display as the sputtering of the electrodes slowly pumps the impurities out, leaving the display with reduced or no activity.

Another disadvantage of prior art plasma discharge display units is the usually hyperactive plasma discharge that constantly skips around in the enclosed area. In conjunction with this hyperactivity is a buzzing noise, which together decrease the overall aesthetic of the display.

Therefore, there is a need for a plasma discharge display unit that produces a full motion and continuous plasma discharge that is active (but not hyperactive) without the addition of adulterants and with reduced noise.

SUMMARY OF THE INVENTION

The invention provides a device for displaying active plasma discharge having a full motion and being continuous without the addition of adulterants and with minimal operating noise.

The plasma discharge display unit of the present invention provides a unique chamber construction where ionized gas travels to produce a full motion and continuous plasma discharge without the addition of adulterants for activity.

The device for displaying plasma discharge of the present invention comprises a generally elongated body having a cylindrical upper portion and a generally spherical lower portion to form a single wall columnar chamber for gases to be ionized. The cylindrical and spherical portions are axially aligned. Two electrodes connected to a power source are at opposite ends of the columnar chamber, tangentially located at the upper and lower ends and orthogonal to the longitudinal axis.

In operation, plasma discharge is generated at the electrode located at the bottom end. Due to the generally spherical lower portion, ionized gas is deflected from going straight up towards the upper end such that the plasma discharge appears to originate from varying departure sources at the bottom end of the lower portion. In combination with the heat generated by the plasma discharge in the chamber, the plasma discharge is able to maintain a continuous plasma discharge from the bottom to the upper ends. The curved inner surfaces of the upper and lower portions allow electrostatic attraction of the ionized gas to deflect to generate an active plasma discharge.

At least two sources of instability are introduced by the configuration of the columnar chamber of the present invention to provide an active display of plasma discharge without the addition of adulterants.

DETAILED DESCRIPTION OF THE PREFERRED EMBODIMENTS

Figure 1:
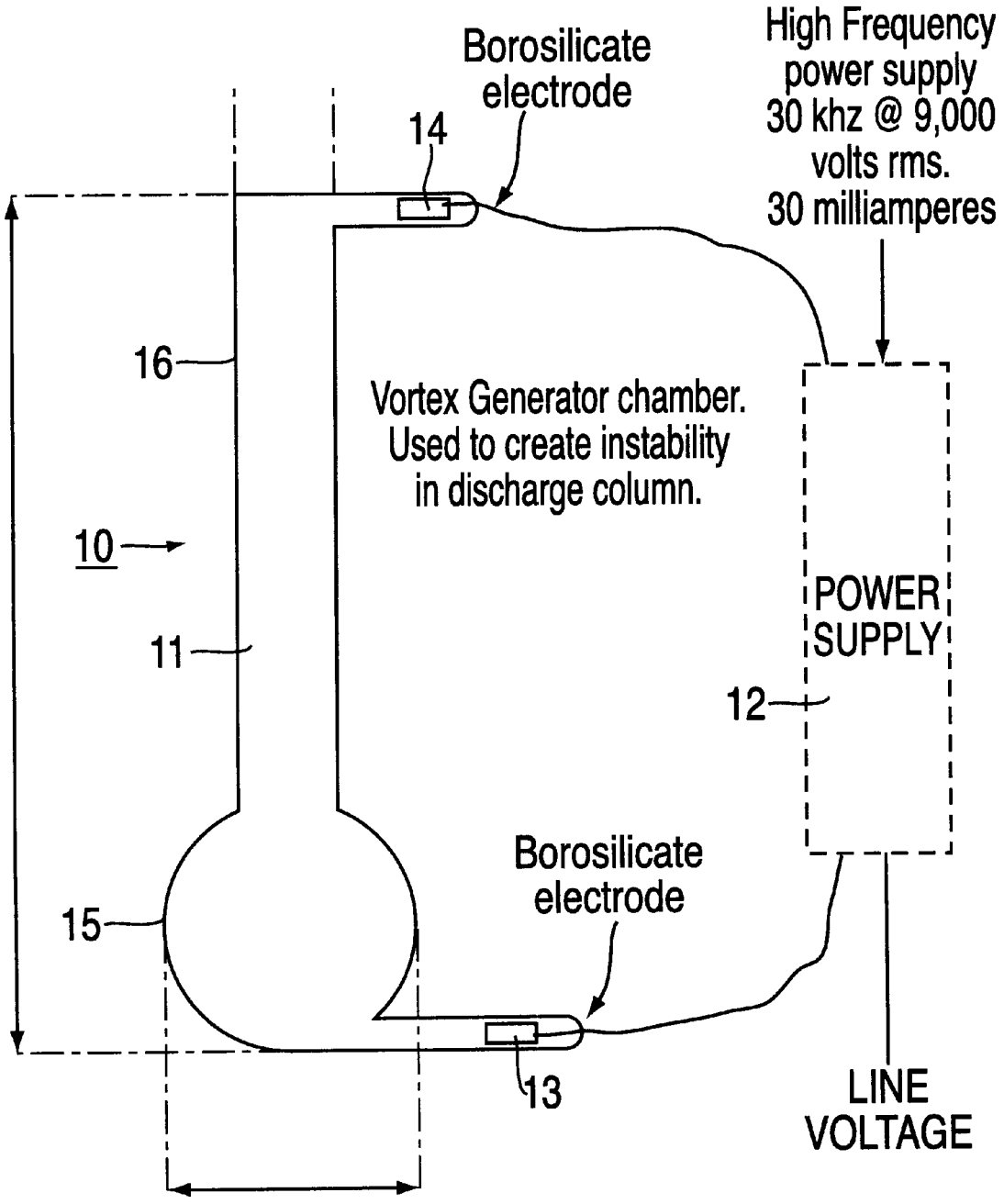
FIG. 1 is a side view of a columnar chamber of the present invention for ionizing gas for plasma discharge display.

With reference to the drawings, wherein the same reference number indicates the same element throughout, there is shown in FIG. 1 a device 10 for displaying active plasma discharges. The device 10 comprises a generally columnar chamber 11 connected to a power supply 12 via two electrodes 13 and 14.

Figure 2:
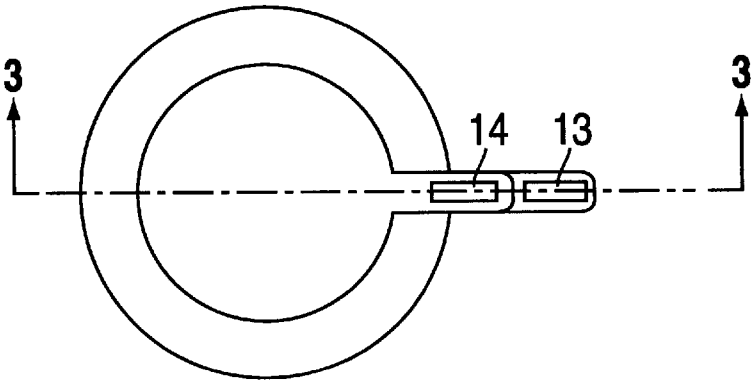
FIG. 2 is the top plan view of the columnar chamber illustrating the axially aligned cylindrical and generally spherical portions.

As shown in FIGS. 1 and 2, the generally columnar single wall glass chamber 11 comprises a generally spherical lower portion 15 axially aligned and interconnected with a cylindrical upper portion 16. The diameter of the cylindrical portion 16 is smaller than the diameter of the generally spherical portion 15. The curvature of the spherical and cylindrical portions 15 and 16 of chamber 11 electrostatically attracts and deflects the high frequency ionized gas to generate an active plasma discharge display. Electrodes 13 and 14 are tangentially located at the lower and upper ends of chamber 11, respectively, orthogonal to the longitudinal axis of chamber 11.

Chamber 11 is filled with gases to be ionized. Any type and pressure of gas known to one skilled in the art of plasma discharge display can be used. For example, high purity Krypton gas (inert gas) at one third of atmospheric pressure can be used. Preferably, chamber 11 also contains a gettering agent to adsorb impurities of the gas in chamber 11 over the life of the device 10. Different gettering agent, such as oxygen, nitrogen or hydrogen, known to one skilled in the art can be used. Different types of electrodes 13 and 14, known to one skilled in the art, such as borosilicate electrode, can be used. Similarly, different types of power supply 12 that produce high frequency, known to one skilled in the art, such as a neon sign type transformer with adjustable output for tuning to the specified size of the columnar chamber 11 and type of gas, can be used.

The configuration of the columnar chamber 11 of the present invention introduces instability to the ionized gas without the need of additional adulterant as in the prior art devices. With the power supply 12 in operation, e.g. at 25–30 kHz, 9 kV rms and 15–30 mA, electrode 13 at the bottom end of chamber 11 initiates the ionization of gas.

Figure 3:
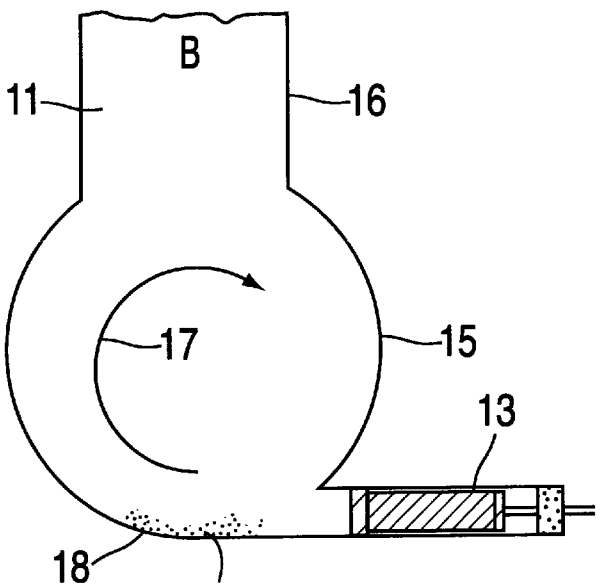
FIG. 3 is a partial cross sectional view taken along line 3—3 in FIG. 2 illustrating ionized gas activity at the generally spherical portion of the columnar chamber.

As illustrated in FIG. 3, ionized gas is attracted to a flat area A where the spherical portion 15 meets the electrode 13, which deflects the ionized gas (or plasma discharge) from travelling a straight path directly towards electrode 14 at the upper end of chamber 11. Instead, the ionized gas appears to originate from varying departure sources at the bottom end of chamber 11 because the ionized gas is deflected against the spherical portion 15 before travelling up the cylindrical portion 16. The deflected ionized gas is generally represented by directional arrow 17. As shown in FIG. 3, flat area A may also have a grounded conductive coating 18 to effectuate the deflection of ionized gas.

As the ionized gas generates heat within chamber 11, a further instability from the rising currents of warm gas is introduced to the ionized gas travelling in chamber 11. The combination of pulling the source of the ionized gas off center from the electrostatic surfaces of the spherical and cylindrical portions 15 and 16 and the thermal currents generated inside chamber 11 take maximum advantage of the construction of chamber 11 to generate an active, continuous, full-motion plasma discharge from end to end of the chamber 11 with minimal noise and without additional adulterants. A device 10 built in accordance with the invention has been tested into the ten thousand-hour life without defaulting to the laminar mode.

Figure 4:
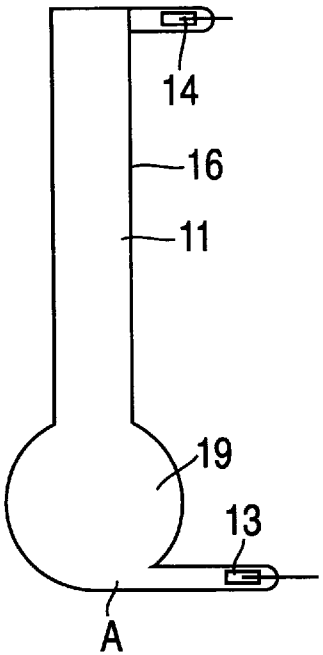
FIG. 4 is an alternative embodiment of the present invention with an elliptical lower portion.

In an alternative embodiment of the present invention, chamber 11 may has an elliptical lower portion, as shown in FIG. 4. The elliptical lower portion provides a larger flat surface area A for deflecting the ionized gas.

Although certain features of the invention have been illustrated and described herein, other modifications and changes will occur to those skilled in the art. It is, therefore, to be understood that the appended claims are intended to cover all such modification and changes that fall within the spirit of the invention.

What I claim is:

1. A device for displaying plasma discharge comprising:

a generally columnar chamber having opposite ends defining a longitudinal axis, said chamber containing gas for ionization and having a cylindrical portion interconnected with a generally spherical portion;

first and second electrodes being tangential to and at each of said opposite ends of said chamber orthogonal to said axis for ionizing said gas; and a power supply for supplying high frequency voltage to said first and second electrodes.

2. The device of claim 1 wherein said cylindrical portion is axially aligned with said spherical portion.

3. The device of claim 2 further comprising a grounded conductive coating at one of said opposite ends of said chamber at said spherical portion.

4. The device of claim 1 wherein said first electrode being tangential to said cylindrical portion at one of said opposite ends and said second electrode being tangential to said spherical portion at the other opposite end.

5. The device of claim 1 wherein said first electrode being tangential to said cylindrical portion at one of said opposite ends and said second electrode being tangential to said spherical portion at the other opposite end.

6. A device for displaying plasma discharge comprising:

a generally columnar chamber having opposite ends defining a longitudinal axis, said chamber containing gas for ionization and having a cylindrical portion interconnected with a generally elliptical portion;

first and second electrodes being tangential to and at each of said opposite ends of said chamber orthogonal to said axis for ionizing said gas; and a power supply for supplying high frequency voltage to said first and second electrodes.

7. The device of claim 6 wherein said cylindrical portion is axially aligned with said portion.

8. The device of claim 7 further comprising a grounded conductive coating at one of said opposite ends of said chamber at said elliphical portion.

* * * * *

UNITED STATES PATENT AND TRADEMARK OFFICE

CERTIFICATE OF CORRECTION

PATENT NO. : 6,420,840 B1
DATED : July 16, 2002
INVENTOR(S) : Larry Albright

It is certified that error appears in the above-identified patent and that said Letters Patent is hereby corrected as shown below:

Column 4,
Line 17, replace the number "1" with the number -- 6 --.
Line 20, replace the word "spherical" with the word -- elliptical --.
Line 36, replace the word "elliphical" with the word -- elliptical --.

Signed and Sealed this

Twenty-fifth Day of March, 2003

JAMES E. ROGAN
*Director of the United States Patent and Trademark Office*